US011367603B2

(12) United States Patent
Kaushal et al.

(10) Patent No.: US 11,367,603 B2
(45) Date of Patent: Jun. 21, 2022

(54) MULTIPLE ANALYTE ION SOURCE

(71) Applicant: PERKINELMER HEALTH SCIENCES CANADA INC, Woodbridge (CA)

(72) Inventors: Frenny Kaushal, Woodbridge (CA); Gholamreza Javahery, Woodbridge (CA); Lisa Cousins, Woodbridge (CA); Charles Jolliffe, Woodbridge (CA)

(73) Assignee: PerkinElmer Health Sciences Canada, Inc., Woodbridge (CA)

( * ) Notice: Subject to any disclaimer, the term of this patent is extended or adjusted under 35 U.S.C. 154(b) by 0 days.

(21) Appl. No.: 16/869,115

(22) Filed: May 7, 2020

(65) Prior Publication Data

US 2020/0350150 A1 Nov. 5, 2020

Related U.S. Application Data

(63) Continuation of application No. PCT/IB2018/058793, filed on Nov. 8, 2018.

(60) Provisional application No. 62/584,425, filed on Nov. 10, 2017.

(51) Int. Cl.
*H01J 49/26* (2006.01)
*H01J 49/04* (2006.01)

(52) U.S. Cl.
CPC ..... *H01J 49/0422* (2013.01); *H01J 49/0404* (2013.01); *H01J 49/26* (2013.01)

(58) Field of Classification Search
CPC .... H01J 49/0422; H01J 49/0404; H01J 49/26; H01J 49/04
USPC ..... 250/281, 282, 288
See application file for complete search history.

(56) References Cited

U.S. PATENT DOCUMENTS 5,872,010 A * 2/1999 Karger ..... B01L 3/0268 436/173
2005/0258359 A1* 11/2005 Guevremont ..... H01J 49/0018 250/288

* cited by examiner

*Primary Examiner* — Michael Maskell
(74) *Attorney, Agent, or Firm* — Rhodes IP PLC; Christopher R Rhodes

(57) ABSTRACT

A device for providing analyte to an analyzer is described. In some examples, the device comprises a substrate comprising a plurality of wells formed therein at predetermined locations. Each of the wells can be capable of containing an analyte without mixing with analytes in other of the wells. Each of the wells can also have a well exit to allow analyte to exit therefrom. A channel can be in flow communication with at least one of the well exits, and can guide analyte ions exiting therefrom to the mass analyzer. The wells may be filled prior to use in association with the mass analyzer. The substrate may be used as part of a fraction collector if desired.

18 Claims, 3 Drawing Sheets

MULTIPLE ANALYTE ION SOURCE

PRIORITY APPLICATION

This application is related to, and claims priority to and the benefit of, U.S. Provisional Application No. 62/584,425 filed on Nov. 10, 2017, the entire disclosure of which is hereby incorporated herein by reference for all purposes. This application is also a continuation application of PCT/IB2018/058793 filed on 8 Nov. 2018.

TECHNOLOGICAL FIELD

The present invention relates generally to molecular and atomic analysis and more particularly to ion sources for use with molecular and/or atomic analysis devices, such as mass spectrometers, and related methods.

BACKGROUND

Molecular and atomic analysis, such as mass spectrometry, has proven to be an effective analytical technique for identifying unknown compounds and for determining the precise mass of known compounds. Advantageously, compounds can be detected or analyzed in minute quantities allowing compounds to be identified at very low concentrations in chemically complex mixtures. Not surprisingly, mass spectrometry has found practical applications in medicine, pharmacology, food sciences, semi-conductor manufacturing, environmental sciences, security, and many other fields.

SUMMARY

In an aspect, a device for providing analyte to an analyzer is provided. The device comprises a substrate, having a plurality of wells therein at predetermined locations. Each of the wells can be configured to receive and/or contain an analyte, e.g., is capable of containing an analyte without mixing with analytes in other of the wells. Each of the wells comprises a well exit to allow analyte to exit therefrom. A channel is in flow communication with or is fluidically coupled to at least one of the well exits, for guiding analyte ions exiting therefrom to the mass analyzer.

In certain embodiments, the device comprises a first gas source configured to urge analyte in at least one of the wells therefrom. In other embodiments, the device comprises a mechanical translator configured to position the first gas source at a predetermined location above a selected one of the wells to urge analyte from the selected one of the wells. In some examples, the device comprises a second gas source configured to provide a transport gas to the channel for transporting analyte to an entrance of the mass analyzer.

In certain embodiments, the substrate is a plate. In some examples, the plate is formed of metal. In other examples, the wells are arranged in a regular geometric pattern in the plate. In some embodiments, the regular geometric pattern is a two dimensional array. In other examples, the plate is generally rectangular. In some embodiments, the plate is generally round. In some embodiments, the plate comprises at least 96 of the wells or 384 wells or at least 1000 wells. In some examples, the wells are vials. In other examples, the wells are integrally formed as part of the substrate. In certain embodiments, In other configurations, the mass analyzer is a mass spectrometer. In some examples, In certain embodiments, the plate is removable, and the wells may be filled at a location away from the device. In some instances, the channel is formed in a vessel, sized to receive the plate thereon. In other examples, the vessel includes an outlet for attachment to the mass analyzer.

In certain instances, each of the well exits comprises a conductive tip comprising a tip inner diameter of about 50 microns. In some examples, each of the well exits comprises an electrospray tip. In some examples, a potential between about 0-6 kV is applied to each electrospray tip.

In another aspect, a device for providing analyte to a mass spectrometer is described. The device comprises a substrate, having a plurality of sample wells therein at predetermined locations. Each of the sample wells is configured to receive and/or contain a flow of analyte sample, e.g., is capable of containing a flow of analyte sample without mixing with analyte in other of the sample wells. Each of the sample wells comprises an exit. A sample flow device urges sample to flow through the sample inlets urging sample analyte to flow through the exit therefrom. A voltage source produces analyte ions from the sample analyte urged from the sample wells. A channel is in flow communication with or is fluidically coupled to at least one of the well exits, for guiding analyte urged ions to the mass spectrometer.

According to another aspect, a method for providing analyte to a mass analyzer is disclosed. The method comprises eluting fractions of analyte from a liquid source, directing each of the fractions to one of a plurality of individual wells of a substrate, the substrate having a plurality of individual wells at predetermined locations. Each of the wells is configured to receive and/or contain an analyte, e.g., is capable of containing an analyte without mixing with analytes in other of the wells. Each of the wells comprises a well exit to allow analyte to exit therefrom. The method further includes interconnecting a channel in flow communication with or fluidically coupled to at least one of the well exits to guide selected analyte ions exiting therefrom to the mass analyzer.

According to another aspect, a fraction collector system comprises a substrate comprising a plurality of sample wells therein at predetermined locations. Each of the sample wells comprises an opening extending from a top surface of the substrate, and is configured to receive and/or contain a flow of analyte sample, e.g., is capable of containing a flow of analyte sample without mixing with analyte in other of the sample wells. Each of the sample wells also comprises an exit on a bottom surface of the substrate.

In some examples, the system comprises a separation device operable to separate a mixture of analyte into one or more constituent components. In other examples, the system comprises a translator configured to move the constituent components into individual ones of the sample wells. In some examples, the system comprises a detector configured to detect physical or chemical properties of the constituent components. In other examples, the detector is in communication with the translator to control placement of each of the constituent components into one of the sample wells.

Other aspects and features of the present invention will become apparent to those of ordinary skill in the art upon review of the following description of specific embodiments of the invention in conjunction with the accompanying figures.

BRIEF DESCRIPTION OF THE SEVERAL VIEWS OF THE DRAWINGS

Certain configurations are described in reference to the figures in which.

Figure 1A:
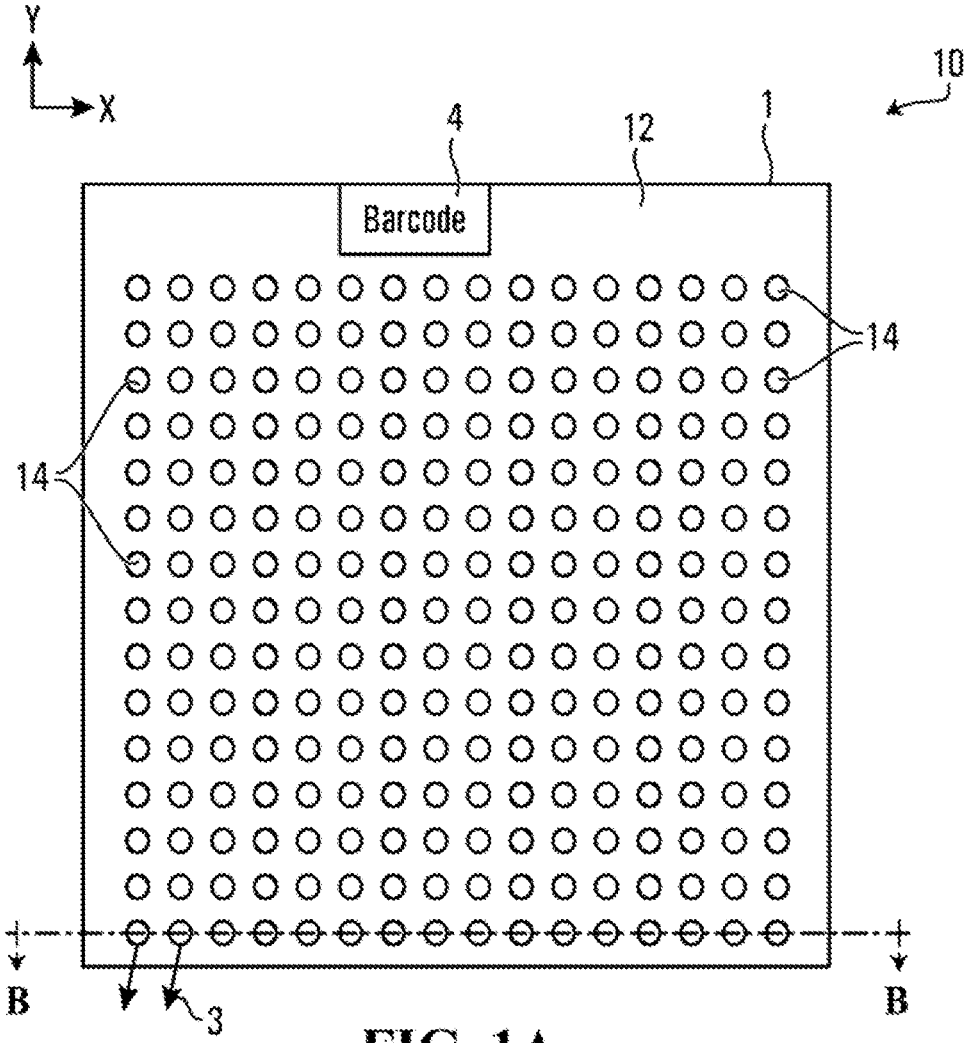
FIG. 1A is a top plan view of a dispensing plate for use with an ion source, exemplary of an embodiment.

It will be recognized by the skilled person in the art, given the benefit of this disclosure, that all features in the figures are not necessarily shown to scale. Certain dimensions may be enlarged, distorted or otherwise altered to enhance clarity or to provide a more user friendly representation of the figure.

DETAILED DESCRIPTION

The exact configuration of the devices and system described herein can vary depending on the particular type and/or amount of analytes to be analyzed. A typical molecular analyzer comprises an ion source that ionizes particles of interest. In a mass spectrometer, the ions are passed to a mass analyzer, where they are separated according to their mass (m)-to-charge (z) ratios (m/z). The separated ions are detected at a detector. A signal from the detector may be sent to a computing or similar device where the m/z ratios may be stored together with their relative abundance for presentation in the format of a m/z spectrum. Mass spectrometers are discussed generally in "Electrospray Ionization Mass Spectrometry, Fundamentals, Instrumentation & Applications" edited by Richard B. Cole (1997) ISBN 0-4711456-4-5 and documents referenced therein.

Electrospray ionization (ESI) is a widely used ionization technique for mass spectrometry, due to its ability to generate large molecular ions with minimal fragmentation. Analyte sample is typically dissolved in a solvent and buffer mixture held at a pH to enhance formation of molecular adducts in solution. Analyte liquid, including analyte sample dissolved in one or more solvents, can be delivered through a small capillary tube positioned within a large volume plenum chamber. The plenum chamber houses the capillary tube and an exhaust drain for the liquid flow. The mass spectrometer sampling orifice can be positioned in the plenum chamber, in close proximity to the capillary tube Electrospray ions are generated by a high voltage applied to the capillary tube. An electric field is established between the capillary tube and a surface in close proximity to the sampling orifice of the mass spectrometer—usually the sampling orifice itself. The electric field is very strong at the tip of the capillary and, through the electrospray, induces charge separation. As a result the liquid sample is nebulized and an ion plume is established.

In some instances, the optimum ESI signal/noise can be dependent upon the positioning of the capillary tip, as well as the position of the capillary tip relative to the nebulizer tip both radially and axially, the nebulizer flow rate, and heat gas flow rate, which are all functions of sample flow rate, and the analyte itself. As a consequence, ions from the ion source are not efficiently sampled by the mass analyzer, causing reduced sensitivity of the mass spectrometer. Often, additional manual or automatic adjustment of the source position is required, decreasing ease of use and increasing cost and complexity.

In certain examples, desolvation from the ESI source is typically incomplete at the analyzer inlet, since there is insufficient time for energy and heat transfer during the time that the charged droplets pass from the tip of the ESI sprayer and into the entrance of the mass spectrometer. This tends to cause an increase in signal fluctuation, reducing the quality of the measurement, and a reduction in the number of analyte ions produced. Thus fewer analyte ions are sampled by the mass spectrometer.

Also, because the analyzer sampling inlet is positioned in the plenum chamber, in close proximity to the capillary tube, any contamination produced by the liquid analyte is sampled by the analyzer, producing further contamination of the analyzer. These disadvantages can be even more problematic for multiple ion sources that operate simultaneously within the same volume. The use of multiple ion sources may increase the number of samples analyzed per unit time (sample throughput) and therefore the information content per unit time.

Other types of ion sources suffer from similar shortcomings. Specifically, atmospheric pressure chemical ionization (APCI) and atmospheric pressure matrix assisted laser desorption ionization (MALDI) also provide issues with contamination and day to day fluctuations in optimization, with simultaneously operating sources even more difficult to use and optimize.

Yet other ionization techniques that rely on chromatography as a separation technique provide limited throughput, as chromatography techniques typically separate molecules in minutes, while a detector such as a mass spectrometer separates molecules over a much smaller timescale, typically milliseconds.

In one configuration, FIG. 1 shows a top view of a dispensing plate 10, for use with a molecular analyzer in an analysis system, exemplary of an embodiment. As illustrated, plate 10 is formed of a substrate 12, such as plastic, metal, ceramic, glass or other suitable material. Plate 10 has a plurality of wells 14 formed therein at predetermined locations. Wells 14 may be constructed as a part of plate 10. Alternatively, wells 14 may each be formed of a vial or similar structures that may be suspended, or otherwise removably retained in plate 10. The vials may be formed of the same material as substrate 12 (e.g. plastic, metal, ceramic, glass) or of a material different than that of substrate 12. Plate 10 is depicted as square or rectangular, but may have any suitable shape—it may be round, oval, or arbitrary in shape.

Figure 1B:
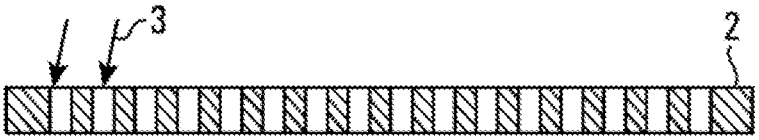
FIG. 1B is a cross-sectional view of FIG. 1A along line A-A.
Figure 2:
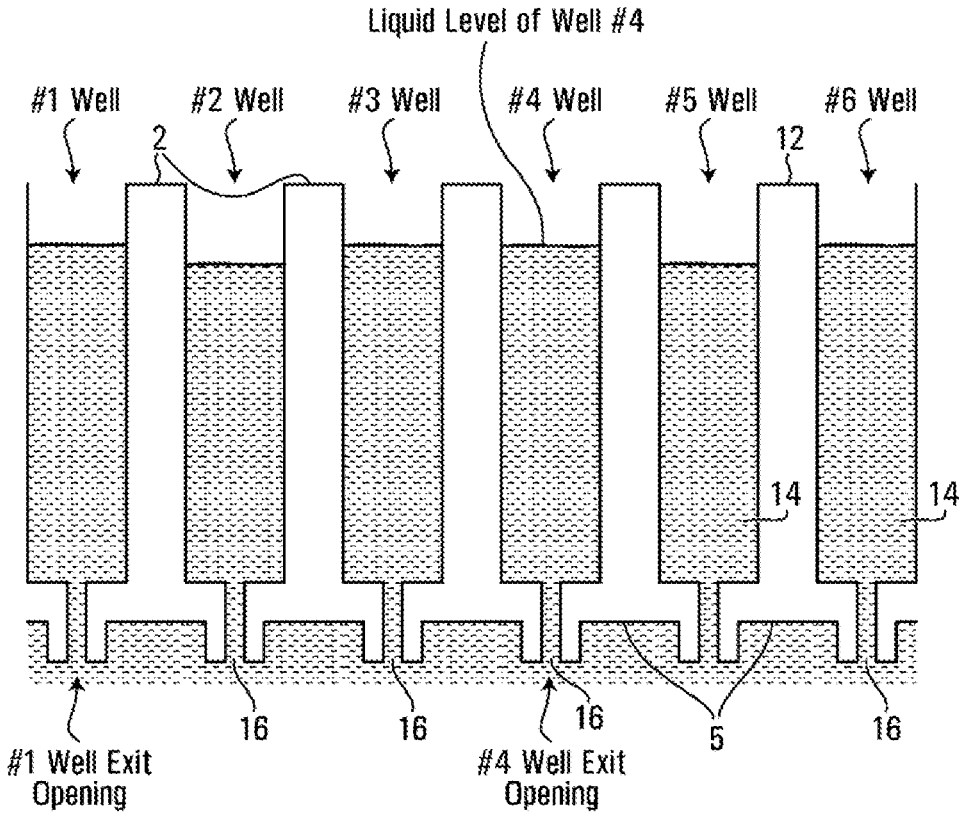
FIG. 2 is an enlarged cross-sectional view of the plate of FIG. 1A.

Plate 10 is further illustrated in cross-section in FIGS. 1B and 2. As illustrated, plate 10 is formed having a finite thickness in which wells 14 may be formed. As such, each well 14 may have a suitable depth to provide the desired volume. In the depicted embodiment, wells 14 are formed at even spaces on a two-dimensional grid—in a regular geometric pattern. As will become apparent, wells 14 could be otherwise arranged, for example in a zig-zag pattern, a circular pattern, or otherwise. Each of wells 14 extends from the top surface of plate 10, and is capable of containing an analyte without mixing with analytes in other of wells 14. Each well 14 may be filled with an analyte in solution. Conveniently, as the content of wells 14 do not mix, each well 14 may be filled with a different analyte. Each well 14 can have a suitable volume—for example 0.5 to 1.0 microliter in volume. For example: a cylinder of 0.5 mm in diameter and 5.0 mm deep will have a volume of close to 1.0 microliter. Other well shapes and sizes may be suitable depending on specific application and work flow.

In certain embodiments, plate 10 may similarly have any suitable size. For example, plates with 96 or 384 wells or more may be used. Alternatively a plate of 20×20 mm can contain more than 1000 wells and similarly, a plate of 30×30 mm can accommodate more than 2500 wells. Each well 14 includes a well exit 16 as illustrated in FIG. 2, extending through a bottom surface of plate 10. Exit 16 allows an analyte to exit from its well 14. Exit dimensions can range from about ten microns to several hundred microns.

Figure 3:
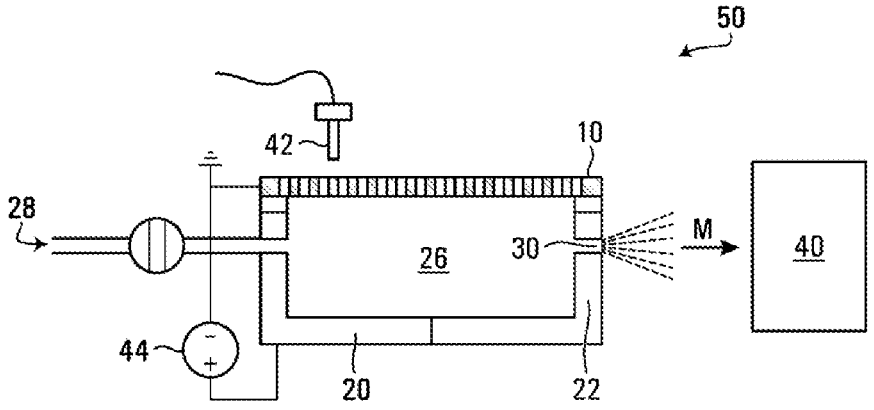
FIG. 3 is a simplified schematic diagram of an exemplary analysis system, including an ion source.

Referring now to FIG. 3, plate 10 may be used in combination with a vessel body 20 in an analysis system 50. Plate 10 covers an opening in vessel body 20, to form an ion transport vessel 22. Vessel 22 at least defines a transport channel 26. Vessel 22 may be similar to the ion vessel disclosed in U.S. Pat. No. 7,405,398, the contents of which are hereby incorporated herein by reference. A transport gas inlet 28 and an outlet 30 extend into and from channel 26, respectively. Outlet 30 feeds the inlet of a mass analyzer 40 in the form of a mass spectrometer or the like. Plate 10 rests atop transport channel 26 so that at least one of well exits 16 is in flow communication with channel 26, e.g., so fluid can flow between the at least one well exit and the channel 26. Vessel body 20 may be formed of a conductive or semi-conductive material. Plate 10 atop vessel body 20 may be electrically isolated from vessel 22 by one or more suitable electrical insulators 32 placed between vessel 22 and plate 10.

In certain examples, a compressed source of gas (not shown) feeds transport gas inlet 28. A control valve 34 is provided to adjust the gas flow rate through channel 26 from inlet 28 to outlet 30. The combination of gas inlet 28, the transport gas, channel 26 and gas outlet 30 and their associated geometries may provide a suitable transport gas flow rate and pressure to deliver charged analyte entrained in the transport gas. Flows can be further controlled using control techniques, including feedback control, in manners understood by those of ordinary skill. The transport gas may be any suitable gas, such as dry air free of contamination. Other gases known to those of ordinary skill, such as Nitrogen, Oxygen, Argon, mixtures containing reactive gases such as NO2 or the like may be used in place of air. The flow of transport gas may form a turbulent and laminar flow for mixing and transporting gas and ionized analyte through channel 26 to a molecular analyzer 40, as, for example, disclosed in U.S. Pat. No. 7,405,398. As will be appreciated, gas through channel 26 entrains analyte released from wells 14.

In some embodiments, prior to use as part of vessel 22, plate 10 may be filled using a mechanical dispenser that may include an x-y-z translator, at a location away from vessel 22 (and any associated analyzer). The mechanical dispenser may be electromechanically controlled, and may move to individual ones of wells 14 to inject a controlled amount of analyte (in solvent) in each well 14 or selected wells 14 for later dispensing. Plate 10 can be stored for later use or reuse (drying, freezing, shelving etc.). Multiple plates of the type of plate 10 can be sequentially used with a single vessel body 20. As each plate 10 is filled, the presence of an existing analyte in a well 14, may optionally be detected using a UV or mass detector read by a second x-y-z translator that may provide the information about wells 14 that are already filled with analyte. The contents of a plate 10 and detention time information can be imprinted or otherwise associated with plate 10. Each plate 10 may be identified by bar code, RFID or any otherwise.

In some examples, plate 10 may optionally be filled with mixture of carrier liquid and analyte. Plate 10 may be optionally prepared using sample preparation and sample extraction methodologies, including liquid/liquid extraction (LLE), solid phase extraction (SPE), for any number of sample matrices, such as food, serum, dried blood spots, and the like.

In certain examples, once plate 10 is atop vessel 22 analyte from any one of wells 14 of plate 10 can be urged out of well exit 16 of that well and into channel 26, by suitable force, by, for example, exerting a downward force on wells 14. The force may be exerted by air, liquid, or otherwise. Conveniently, analyte from each or selected ones of wells 14 can be urged independently, without urging analyte from other wells 14. As such, a positionable actuator 42 may be used to selectively urge analyte from any one of wells 14.

In some configurations, a 2-dimensional (xy) or 3-dimensional (xyz) translator may be employed to position actuator 42 above selected wells 14. The position of actuator 42 may be controlled using a programmable computing device, such as an industrial programmable logic controller, personal computer, or the like. Once above a selected well 14, actuator 42 may be actuated, for example by exerting a downward force on the actuator; releasing a pressurized gas or the like. The downward force on the selected well 14, urges analyte in this well 14 through well exit 16 into channel 26.

In some configurations, the tip of each well exit 16 may be conductive, and circular in cross section, and may for example have a diameter of between about 40 microns and 300 microns. In an embodiment, well exit 16 may have a 50 micron diameter.

If a (first) gas source is used to urge analyte from a selected well 14, the first gas may mix with gas within channel 26.

In certain embodiments, well exit 16 may further act as an electrospray tip (or otherwise be configured to function as or similar to an electrospray tip) to ionize the urged analyte as it enters channel 26. To this end, a voltage source 44 may provide a potential difference of several KV, for example 0 to ±6 kV between vessel body 20 and plate 10. Plate 10 may be maintained at ground potential, and a voltage may be applied to vessel body 20. The potential difference between vessel body 20 and the entrance of analyzer 40 may further transport and focus ions into analyzer 40.

In some embodiments, the preferred flow rate of the analyte from each of wells 14 into channel 26 may be between 50 microliters/min up to a few mL/min although higher flow rates are possible. For example, a 1 microliter well can take 5.0 mins at a flow rate of 200 microliters/min. This rate typically provides sufficient time for a downstream analyzer 40 to analyze any samples introduced into channel 26. As necessary, a user can go back and use the same well for further analysis and conformation which can be useful to further confirm the contents of the well.

In certain instances, those wells 14 can be selected and analyte can be introduced to the mass analyzer 40 by way of channel 26 for analysis substantially in accordance with the speed of actuator 42. In this fashion, a large number of analyte sources (i.e. each well 14) can supply one analyzer 40 and hence increase the throughput of analyzer 40 significantly.

In some examples, as analyte is urged into a channel 26, the effectiveness of mass analyzer 40 and system 50 does not depend on profile of any analyte sprayer, positioning, nebulization, and a sheet gas, as it does in conventional electrospray, micro-spray, and nano-spray analyzers. As outlet 30 of vessel 22 can be fixed to the entrance molecular analyzer, it will not require significant adjustment and care.

If desired, heat may further be provided to channel 26 to assist further desolvation of analyte ions released from wells 14 into channel 26. This flow can be synchronized to the coordinates of the wells 14 and compensate diffusion losses due to different distance of wells 14 from outlet 30. Other reagent (gas or liquid) can be introduced into channel 26 for interaction with analyte. The reagent may be introduced independently or mixed with inlet gas further upstream.

In one embodiment, analyte may be introduced into wells 14 of plate 10, prior to dispensing of analyte from plate 10, by an analyte dispensing device. For example, analyte may be introduced into wells 14 by a liquid handling system such as direct injection for direct injection into wells.

Figure 4:
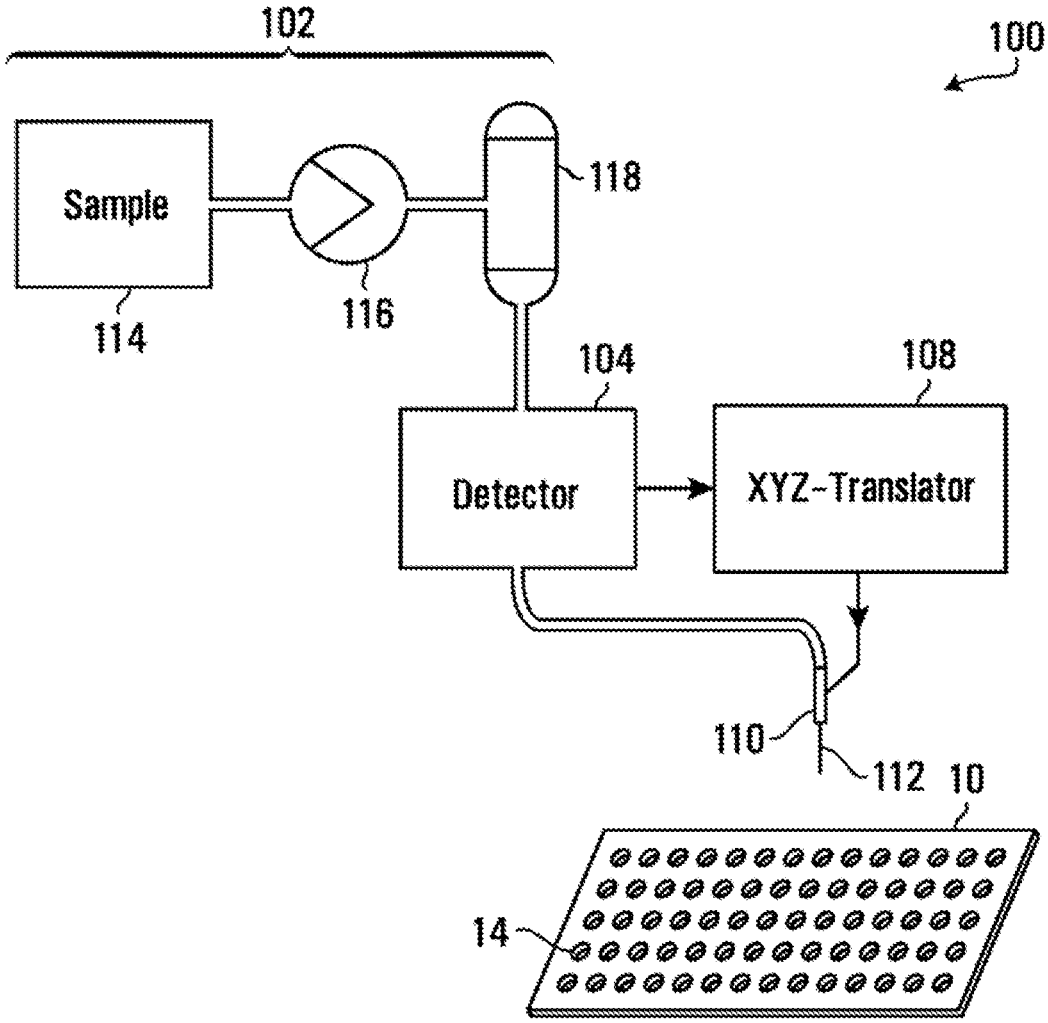
FIG. 4 is a simplified schematic diagram of an exemplary fraction collector, used with a dispensing plate of FIG. 1A.

In a further embodiment, schematically depicted in FIG. 4, one or more plate(s) 10 may be used in combination with a fraction collector system 100—in order to allow for the relative speedy analysis of analyte separated using a relatively slow separation process, provided, for example, by a separation device such as a liquid chromatography (LC) or electrophoresis. Fraction collector system 100 includes a separation device, exemplified as an LC source 102. LC source 102 includes a source 114 of chemicals for analysis. Source 114 may be a mobile phase—e.g. a liquid—that enables the elution of individual chemical components. Individual components may consist of single analytes or groups of analytes depending. A pump 116 provides sample from source 114 to a stationary phase—in the form of an LC column 118—that retains individual components for analysis. Each of the individual components may retain differently and therefore separate from each other as they progress at different speeds through the LC column 118 of LC source 102 with an eluent. At the end of the LC column 118 the components elute one at a time. Optionally eluent may be analyzed by a detector 104 as they elute (detector 104 may be UV, mass-based, or the like). Detector 104 may thus detect physical and/or chemical properties of each component, as it is eluted. The eluted components may be transported by tube 110 of fraction collector 100 from LC source 102. Tube 110 may terminate in a dispensing nozzle 112 that may be translated in space, by a spatial translator 108. Translator 108 may include a mechanical actuator that may, for example, include one or more servo motors (not shown) under processor control (also not shown). Nozzle 112 may thus be translated in a plane (XY) or optionally in 3-space (XYZ). As such, the eluent from LC source 100 may be collected in a series of fractions, by moving nozzle 112. Nozzle 112 may be positioned above individual ones of wells 14 of plate 10. In the depicted embodiment, translator 108 moves nozzle 112. However, plate 10 could alternatively be moved relative to a stationary nozzle. The position of nozzle 112 may for example be controlled in dependence of the output of detector 104, or in dependence on time. The series of fractions may thereby be correlated in time and space: that is, each well 14 corresponds to a particular elution time and therefore analyte fraction.

In some examples, each well 14 may be associated with a time stamp. Optionally, only a subset of the eluent may be deposited into wells 14. Optionally, each well 14 may be indexed under processor control, allowing precise access to any particular analyte eluted from LC source 102 within plate 10. The association of individual wells 14 to detector information may be encoded, as bar code on plate 10. Alternatively, the output of detector 104 and the associated content of a well 14 may be stored in computer memory by detector 104 and conveyed to a downstream mass analyzer.

Returning now to FIG. 3, multiple plates 10 can be filled with analyte (e.g. from an LC source) using fraction collector 100 in advance of use of mass analyzer 40. Once one or more wells 14 are full, plate 10 may be introduced onto vessel body 20. Analyte may be dispensed from wells 14 into channel 26 by way of actuator 42, as described above.

As will be appreciated, typical timescales for liquid chromatography are 5 to 20 minutes. Often, mass spectrometers are forced to acquire over the full time of acquisition although only a portion of the output is of interest. Effectively, plate 10 is digitized with each well 14 corresponding to a time and one or more analytes eluting at that time, such that wells 14 are indexed with analytes of interest. Therefore, it is possible to reduce the analysis time to well below 5 to 20 minutes, by analyzing only the wells containing analyte of interest. In this way the mass spectrometer may be in continual use acquiring only analytes of interest, significantly increasing the productivity of the mass spectrometer and decreasing the time of analysis.

Once analyte from one plate 10 has been depleted, the next plate 10 may be placed on vessel 22, thereby improving the overall speed and efficiency of the workflow.

It will be appreciated that other separation devices aside from LC may also be suitable, such as electrophoresis.

It will also be appreciated that other techniques known in the field such as matrix-induced laser desorption (MALDI) and other laser techniques may be utilized in well 14. For example a laser or light source may be coupled to plate 10 so as to eject ionized analyte from the matrix and into vessel 22.

In some embodiments, the devices and systems described herein can be controlled using one or more processors, e.g., in a controller or as a stand-alone processor, to control and coordinate operation of the system. The processor can be electrically coupled to one or more of the components as well as any other voltage sources included in the system. In certain configurations, the processor may be present in one or more computer systems and/or common hardware circuity including, for example, a microprocessor and/or suitable software for operating the system, e.g., to control the voltages of any pumps, mass analyzer, detector, etc. In some examples, any one or more components of the system may comprise its own respective processor, operating system and other features to permit operation of that component. The processor can be integral to the systems or may be present on one or more accessory boards, printed circuit boards or computers electrically coupled to the components of the system. The processor is typically electrically coupled to one or more memory units to receive data from the other components of the system and permit adjustment of the various system parameters as needed or desired. The processor may be part of a general-purpose computer such as those based on Unix, Intel PENTIUM-type processor, Motorola PowerPC, Sun UltraSPARC, Hewlett-Packard PA-RISC processors, or any other type of processor. One or more of any type computer system may be used according to various embodiments of the technology. Further, the system may be connected to a single computer or may be distributed among a plurality of computers attached by a communications network. It should be appreciated that other functions, including network communication, can be performed and the technology is not limited to having any particular function or set of functions. Various aspects may be implemented as specialized software executing in a general-purpose computer system. The computer system may include a processor connected to one or more memory devices, such as a disk drive, memory, or other device for storing data. Memory is typically used for storing programs, calibrations and data during operation of the system in the various modes using the gas mixture. Components of the computer system may be coupled by an interconnection device, which may include one or more buses (e.g., between components that are integrated within a same machine) and/or a network (e.g., between components that reside on separate discrete machines). The interconnection device provides for communications (e.g., signals, data, instructions) to be exchanged between components of the system. The computer system typically can receive and/or issue commands within a processing time, e.g., a few milliseconds, a few microseconds or less, to permit rapid control of the system. For example, computer control can be implemented to control the fluid flow to the substrate, the pressure provided to the substrate to urge fluid exit, the voltages provided to the tips, etc. The processor typically is electrically coupled to a power source which can, for example, be a direct current source, an alternating current source, a battery, a fuel cell or other power sources or combinations of power sources. The power source can be shared by the other components of the system. The system may also include one or more input devices, for example, a keyboard, mouse, trackball, microphone, touch screen, manual switch (e.g., override switch) and one or more output devices, for example, a printing device, display screen, speaker. In addition, the system may contain one or more communication interfaces that connect the computer system to a communication network (in addition or as an alternative to the interconnection device). The system may also include suitable circuitry to convert signals received from the various electrical devices present in the systems. Such circuitry can be present on a printed circuit board or may be present on a separate board or device that is electrically coupled to the printed circuit board through a suitable interface, e.g., a serial ATA interface, ISA interface, PCI interface or the like or through one or more wireless interfaces, e.g., Bluetooth, Wi-Fi, Near Field Communication or other wireless protocols and/or interfaces.

In certain embodiments, the storage system used in the systems described herein typically includes a computer readable and writeable nonvolatile recording medium in which codes can be stored that can be used by a program to be executed by the processor or information stored on or in the medium to be processed by the program. The medium may, for example, be a hard disk, solid state drive or flash memory. Typically, in operation, the processor causes data to be read from the nonvolatile recording medium into another memory that allows for faster access to the information by the processor than does the medium. This memory is typically a volatile, random access memory such as a dynamic random access memory (DRAM) or static memory (SRAM). It may be located in the storage system or in the memory system. The processor generally manipulates the data within the integrated circuit memory and then copies the data to the medium after processing is completed. A variety of mechanisms are known for managing data movement between the medium and the integrated circuit memory element and the technology is not limited thereto. The technology is also not limited to a particular memory system or storage system. In certain embodiments, the system may also include specially-programmed, special-purpose hardware, for example, an application-specific integrated circuit (ASIC) or a field programmable gate array (FPGA). Aspects of the technology may be implemented in software, hardware or firmware, or any combination thereof. Further, such methods, acts, systems, system elements and components thereof may be implemented as part of the systems described above or as an independent component. Although specific systems are described by way of example as one type of system upon which various aspects of the technology may be practiced, it should be appreciated that aspects are not limited to being implemented on the described system. Various aspects may be practiced on one or more systems having a different architecture or components. The system may comprise a general-purpose computer system that is programmable using a high-level computer programming language. The systems may be also implemented using specially programmed, special purpose hardware. In the systems, the processor is typically a commercially available processor such as the well-known Pentium class processors available from the Intel Corporation. Many other processors are also commercially available. Such a processor usually executes an operating system which may be, for example, the Windows 95, Windows 98, Windows NT, Windows 2000 (Windows ME), Windows XP, Windows Vista, Windows 7, Windows 8 or Windows 10 operating systems available from the Microsoft Corporation, MAC OS X, e.g., Snow Leopard, Lion, Mountain Lion or other versions available from Apple, the Solaris operating system available from Sun Microsystems, or UNIX or Linux operating systems available from various sources. Many other operating systems may be used, and in certain embodiments a simple set of commands or instructions may function as the operating system.

In certain examples, the processor and operating system may together define a platform for which application programs in high-level programming languages may be written. It should be understood that the technology is not limited to a particular system platform, processor, operating system, or network. Also, it should be apparent to those skilled in the art, given the benefit of this disclosure, that the present technology is not limited to a specific programming language or computer system. Further, it should be appreciated that other appropriate programming languages and other appropriate systems could also be used. In certain examples, the hardware or software can be configured to implement cognitive architecture, neural networks or other suitable implementations. If desired, one or more portions of the computer system may be distributed across one or more computer systems coupled to a communications network. These computer systems also may be general-purpose computer systems. For example, various aspects may be distributed among one or more computer systems configured to provide a service (e.g., servers) to one or more client computers, or to perform an overall task as part of a distributed system. For example, various aspects may be performed on a client-server or multi-tier system that includes components distributed among one or more server systems that perform various functions according to various embodiments. These components may be executable, intermediate (e.g., IL) or interpreted (e.g., Java) code which communicate over a communication network (e.g., the Internet) using a communication protocol (e.g., TCP/IP). It should also be appreciated that the technology is not limited to executing on any particular system or group of systems. Also, it should be appreciated that the technology is not limited to any particular distributed architecture, network, or communication protocol.

In some instances, various embodiments may be programmed using an object-oriented programming language, such as, for example, SQL, SmallTalk, Basic, Java, Javascript, PHP, C++, Ada, Python, iOS/Swift, Ruby on Rails or C# (C-Sharp). Other object-oriented programming languages may also be used. Alternatively, functional, scripting, and/or logical programming languages may be used. Various configurations may be implemented in a non-programmed environment (e.g., documents created in HTML, XML or other format that, when viewed in a window of a browser program, render aspects of a graphical-user interface (GUI) or perform other functions). Certain configurations may be implemented as programmed or non-programmed elements, or any combination thereof. In some instances, the systems may comprise a remote interface such as those present on a mobile device, tablet, laptop computer or other portable devices which can communicate through a wired or wireless interface and permit operation of the systems remotely as desired.

When introducing elements of the examples disclosed herein, the articles "a," "an," "the" and "said" are intended to mean that there are one or more of the elements. The terms "comprising," "including" and "having" are intended to be open-ended and mean that there may be additional elements other than the listed elements. It will be recognized by the person of ordinary skill in the art, given the benefit of this disclosure, that various components of the examples can be interchanged or substituted with various components in other examples.

Although certain aspects, configurations, examples and embodiments have been described above, it will be recognized by the person of ordinary skill in the art, given the benefit of this disclosure, that additions, substitutions, modifications, and alterations of the disclosed illustrative aspects, configurations, examples and embodiments are possible.

What is claimed is:

1. A device for providing analyte to a mass analyzer, the device comprising:

a substrate comprising a plurality of wells therein at predetermined locations, each of the plurality of wells of the substrate configured to receive and contain an analyte without mixing with analytes in other of the wells, wherein each of the wells comprises a well exit to allow analyte to exit therefrom;

a channel fluidically coupled to at least one of the well exits, wherein the channel is configured to guide analyte ions exiting therefrom to the mass analyzer;

a first gas source configured to urge analyte in at least one of the wells therefrom; and a mechanical translator configured to position the first gas source at a predetermined location above a selected one of the wells to urge analyte from the selected one of the wells.

2. The device of claim 1, further comprising a second gas source configured to provide a transport gas to the channel for transporting analyte to an entrance of the mass analyzer.

3. The device of claim 1, wherein the substrate is a plate.

4. The device of claim 3, wherein the plate is formed of metal.

5. The device of claim 4, wherein the wells are arranged in a regular geometric pattern in the plate.

6. The device of claim 5, wherein the regular geometric pattern is a two dimensional array.

7. The device of claim 4, wherein the plate is generally rectangular.

8. The device of claim 4, wherein the plate is generally round.

9. The device of claim 3, wherein the plate comprises at least 96 of the wells.

10. The device of claim 3, wherein the plate comprises at least 384 of the wells.

11. The device of claim 3, wherein the plate comprises at least 1000 of the wells.

12. The device of claim 3, wherein the wells are vials.

13. The device of claim 3, wherein the wells are integrally formed as part of the substrate.

14. The device of claim 1, wherein the mass analyzer is a mass spectrometer.

15. The device of claim 1, wherein each of the well exits comprises a conductive tip comprising a tip inner diameter of about 50 microns.

16. A method for providing analyte to a mass analyzer, the method comprising:

eluting fractions of analyte from a liquid source;

directing each of the eluted fractions to one of a plurality of individual wells of a substrate, wherein the substrate comprises a plurality of the individual wells therein at predetermined locations, each of the wells capable of containing an analyte without mixing with analytes in other of the wells, wherein each of the wells comprises a well exit to allow analyte to exit therefrom;

positioning a first gas source at a predetermined location above a selected one of the individual wells to urge analyte from the well exit of the selected one of the individual wells; and interconnecting a channel in flow communication with the well exit of the selected one of the individual wells to guide selected analyte urged therefrom to the mass analyzer.

17. A fraction collector system comprising:

a substrate comprising a plurality of formed sample wells therein at predetermined locations, wherein each of the formed sample wells comprises an opening extending from a top surface of the substrate and is configured to contain a flow of analyte sample without mixing with analyte in other of the formed sample wells, and wherein each of the formed sample wells comprises an exit on a bottom surface of the substrate;

a channel fluidically coupled to at least one of the formed sample well exits, wherein the channel is configured to guide analyte ions exiting therefrom to a mass analyzer;

a first gas source configured to urge analyte in at least one of the formed sample wells therefrom; and a mechanical translator configured to position the first gas source at a predetermined location above a selected one of the openings in the formed sample wells to urge analyte from the selected one of the formed sample wells.

18. The fraction collector system of claim 17, further comprising a separation device operable to separate a mixture of analyte into one or more constituent components.

* * * * *